US006464622B2

(12) United States Patent
Clark

(10) Patent No.: US 6,464,622 B2
(45) Date of Patent: Oct. 15, 2002

(54) EXERCISE DEVICE AND METHOD OF USE

(75) Inventor: Michael Clark, Wadsworth, OH (US)

(73) Assignee: Fitness Quest Inc., Canton, OH (US)

( * ) Notice: Subject to any disclaimer, the term of this patent is extended or adjusted under 35 U.S.C. 154(b) by 0 days.

(21) Appl. No.: 09/981,542

(22) Filed: Oct. 17, 2001

(65) Prior Publication Data

US 2002/0098946 A1 Jul. 25, 2002

Related U.S. Application Data

(60) Provisional application No. 60/262,881, filed on Jan. 19, 2001.

(51) Int. Cl.[7] ..... A63B 69/32; A63B 69/34
(52) U.S. Cl. ..... 482/84; 482/83; 482/1
(58) Field of Search ..... 482/83–90, 1–9

(56) References Cited

U.S. PATENT DOCUMENTS

| | | | | |
|---|---|---|---|---|
| 3,933,354 A | | 1/1976 | Goldfarb et al. | |
| 4,088,315 A | | 5/1978 | Schemmel | |
| 4,209,168 A | * | 6/1980 | Partlow | 272/78 |
| 4,634,116 A | * | 1/1987 | Amador et al. | 272/77 |
| 4,818,234 A | | 4/1989 | Redington et al. | |
| 4,974,833 A | | 12/1990 | Hartman et al. | |
| 5,052,683 A | | 10/1991 | Wang et al. | |
| 5,271,627 A | | 12/1993 | Russell et al. | |
| 5,330,403 A | | 7/1994 | Kuo | |
| 5,584,779 A | | 12/1996 | Knecht et al. | |
| 5,624,358 A | | 4/1997 | Hestilow | |
| 5,716,302 A | | 2/1998 | Andersson | |
| 5,792,032 A | | 8/1998 | Williams et al. | |
| 6,220,992 B1 | * | 4/2001 | Shafik | 482/83 |

* cited by examiner

*Primary Examiner*—Michael A. Brown
*Assistant Examiner*—Lori Baker Amerson
(74) *Attorney, Agent, or Firm*—Sand & Sebolt

(57) ABSTRACT

An exercise device includes a bag suspended by a swivel beneath a flat horizontal surface of a support structure adapted to be repeatedly struck by the user. A series of responsive zones are provided on the surface and provide signals to an electronic control system each time a zone is contacted by the bag after being struck by the user. A series of lights are mounted on the surface, each associated with a respective one of the zones, to indicate to a user which zone is to be contacted by the bag. The electronic control system provides a measurable feedback on a monitor of the number of times a selected zone is contacted by the bag within a selected time period. A number of different exercise programs are provided by the electronic control system to test the speed of striking the bag by the user.

23 Claims, 6 Drawing Sheets

EXERCISE DEVICE AND METHOD OF USE

CROSS REFERENCE TO RELATED APPLICATION

This standard utility patent application is based on Provisional Patent Application Serial No. 60/262,881 filed Jan. 19, 2001 in the United States Patent and Trademark Office.

BACKGROUND OF THE INVENTION

1. Technical Field

The invention relates to an exercise device and in particular to a boxing device wherein the user strikes a speed bag in a programmed order and the device provides a measurable feedback as to the speed, accuracy and control with which the user strikes the bag.

2. Background Information

There are numerous types of exercise devices which provides the user with some type of feedback indicating the amount of exercise being performed. Some of these devices indicate the number of strikes that an object takes by the exerciser, and provides for a random or programmed sequence of targets on the object and a particular order for striking the target. For example, U.S. Pat. Nos. 3,933,354, 4,088,315, 4,974,833, and 5,716,302 disclose target devices with electronic sensors and signaling devices, which are struck by the user. However, all of these devices require striking either a planar surface having pressure sensitive targets or strike areas, or require striking a simulated body torso.

A "speed bag" is a small bag containing an inflatable bladder which is suspended on a swivel from a flat platform that is used to develop hand speed and hand-eye coordination in addition to providing aerobic exercise and resistance. Though popular with boxers and martial artists, speed bags also are used by others strictly for exercise and to develop coordination.

There is no known exercise device, and in particular, a device intended for use to objectively measure or to stimulate a boxing workout, which provides a measurable feedback to the user of a speed bag.

SUMMARY OF THE INVENTION

Aspects of the invention include providing an exercise device using an inflatable bag mounted beneath a horizontal platform which is adapted to be repeatedly struck from different angles by a boxer or exerciser, and which provides an objective measurement of the number of times that the bag is struck within a predetermined time period and/or predetermined zone on the underside of the horizontal platform.

The subject invention provides an exercise device in which the underside of the support platform has various strike zones indicated therein, each of which contains a pressure responsive strip of material or other type of detection means which sends a signal to a control device which records the number of times that the pressure sensitive strip or detection means is struck by the bag which generally corresponds to the number of times that the bag is struck by the user.

The exercise device of the invention further provides electronic circuitry which controls the activation of lights, at least one of which is associated with each of the contact zones requiring the user to strike the bag from a different angle or with a different hand depending upon which zone is lighted or activated.

A further aspect of the invention is to provide a series of audio signals or prompts which indicate which zone is to be contacted by the struck bag, and which provides an audio sound or beep each time the activated zone is struck by the bag.

A further aspect of the invention is to provide an exercise device which can be electronically programmed for a speed workout wherein the user strikes the bag with a particular hand and at a particular angle so that the bag strikes each of the responsive zones a specific number of times with the electronic control system recording and providing an objective measurement as to the total time required to strike all of the zones the required number of times.

A still further aspect of the invention is to provide for a timed workout wherein each of the zones is activated for a predetermined time period and the number of bag strikes is recorded for each zone during the activated time period with the total number of bag strikes then being objectively measured and indicated to the user to provide the user with a record of his or her speed.

The device of the present invention also can be programmed to provide a random sequence of the various strike zones requiring quicker reaction on the part of the user, and which can be programmed to provide for various levels of skill and intensity of the workout thereby making it fun and beneficial for individuals of various levels of skill and coordination.

The invention provides a device which can be used by a skilled boxer or amateur boxer to improve his or her boxing skills, hand-eye coordination and/or by an exerciser to achieve a general exercise workout. The device also can be used as an amusement device such as in a restaurant, pub or the like, and provide a competitive comparison of one user's skill verses that of another user's skill.

Another feature of the invention is providing an exercise device in which the electronic control circuit can be incorporated easily into a usual type of speed bag and supporting platform without requiring major alterations thereto, and which does not alter in any matter the method of striking the bag by the user yet provides a variety in the angle which the bag is to be struck and by what hand to improve speed and coordination.

The foregoing advantages, construction, operation, and method steps of the present invention will become more readily apparent from the following description and accompanying drawings.

BRIEF DESCRIPTION OF THE DRAWINGS

The preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENTS

Figure 1:
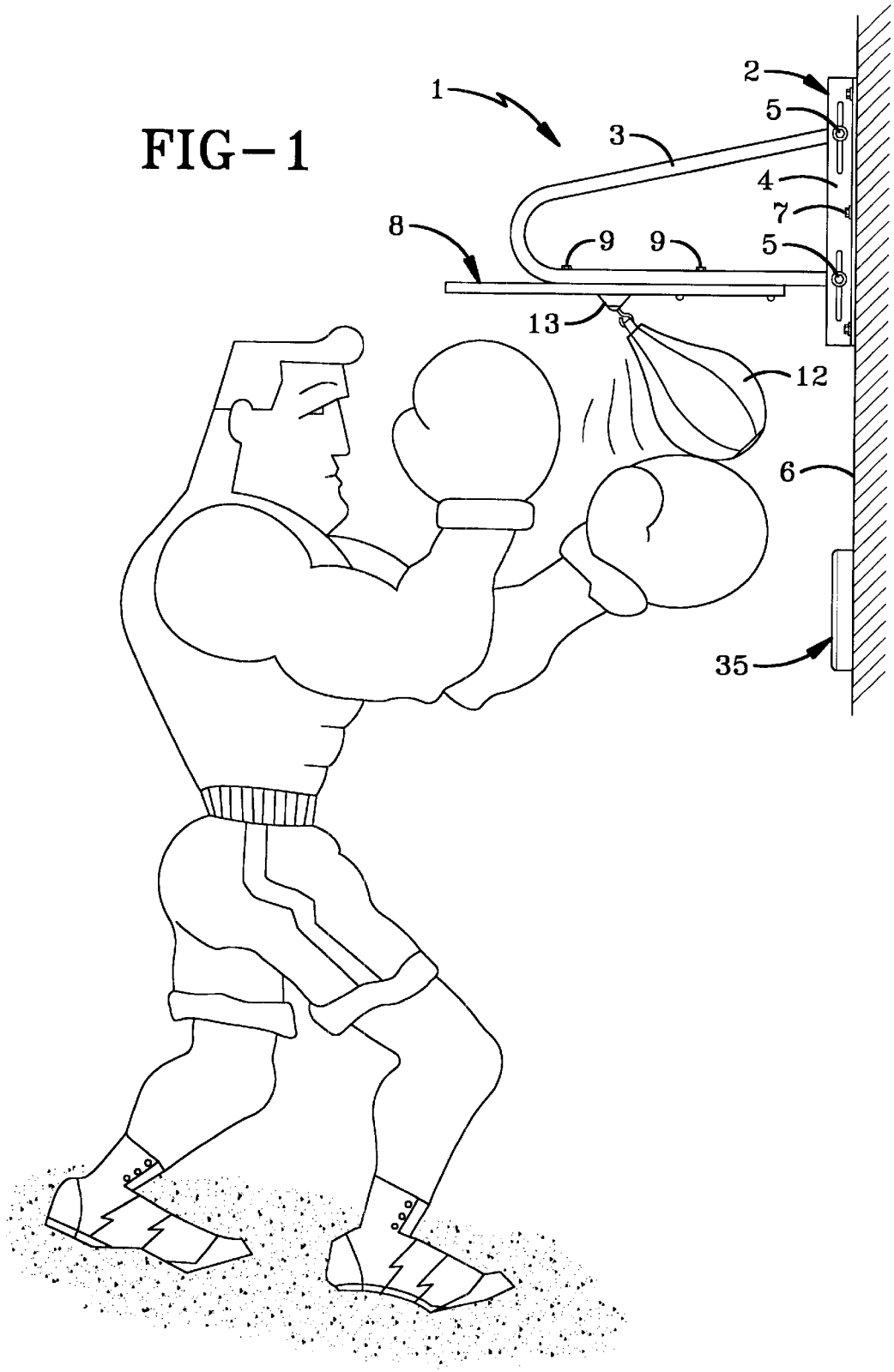
FIG. 1 is a diagrammatic view showing a boxer using the exercise device of the present invention.
Figure 4:
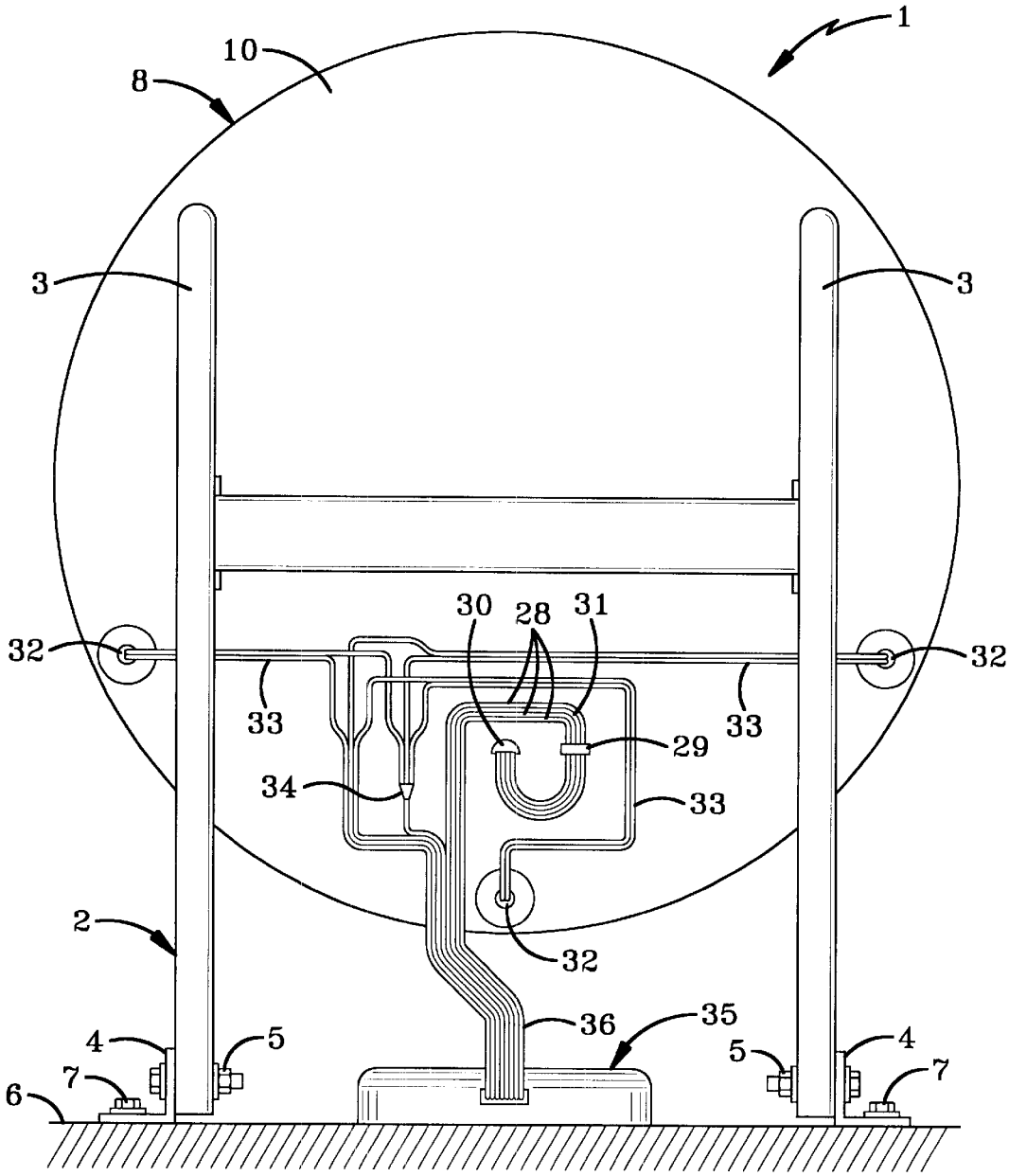
FIG. 4 is a top plan view of the exercise device.
Figure 6:
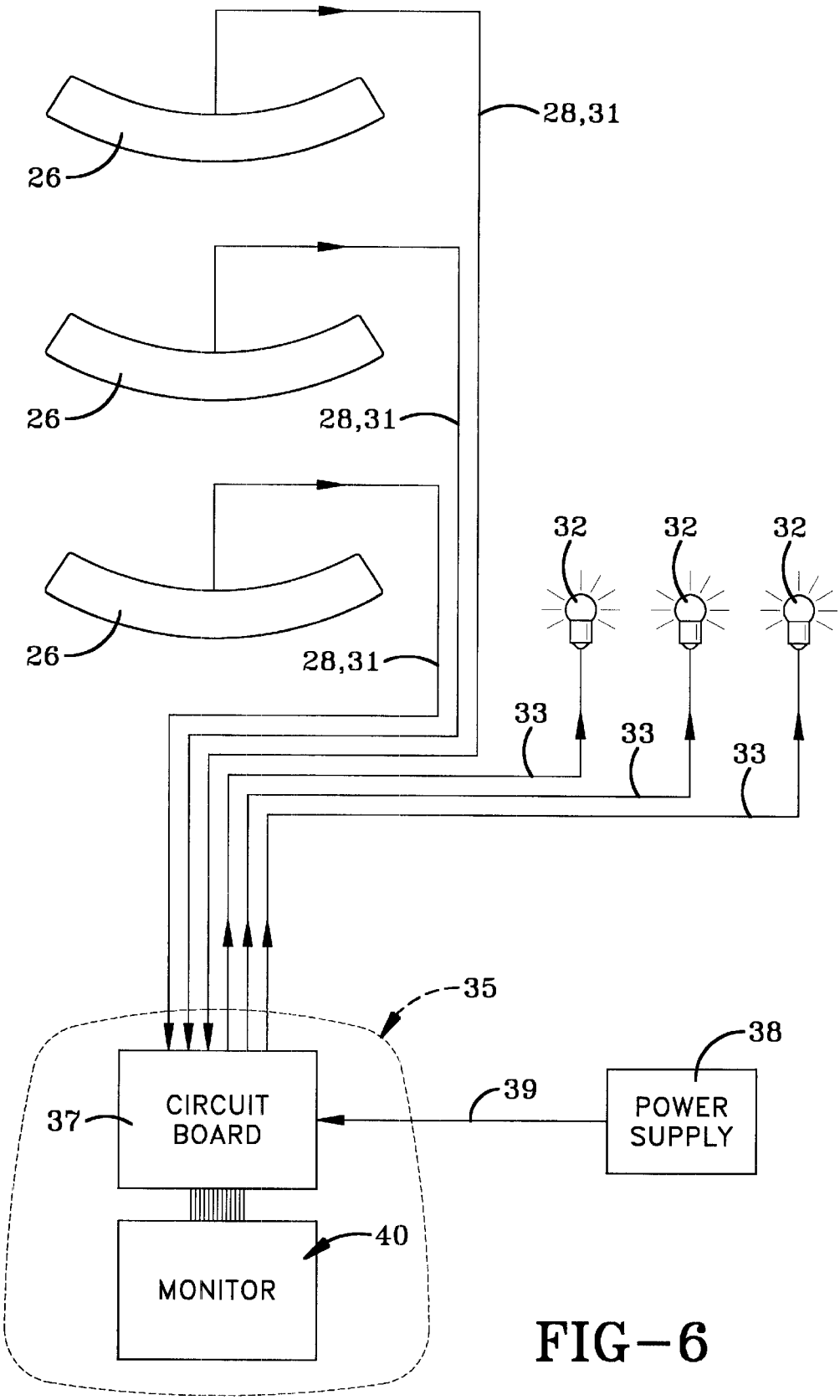
FIG. 6 is a schematic wiring diagram of the electronic control system of the exercise device.

The exercise device of the present invention is indicated generally at 1, and is shown particularly in FIGS. 1 and 4. Device 1 includes a bracket support assembly 2 which consists of a pair outward extending U-shaped bars 3 which are secured to a pair of angle irons 4 by bolts 5. Angle irons 4 preferably are attached to a wall 6 by bolts 7 or other types of fasteners. A platform 8 is secured to bars 3 by bolts 9 and preferably will have a disc-shaped configuration with an upper surface 10 and a lower or underside surface 11. Surface 11 may be planar as shown in the drawing or curved without effecting the concept of the invention. A usual punching or speed bag 12 is suspended from surface 11 by a swivel 13. Bag 12 will usually contain an air inflatable bladder but can be other types of striking devices as descended further below and shown in FIG. 7. The platform construction and support described above and shown in FIGS. 1 and 4 is standard for many types of speed bag installations and can have other supports, mounting arrangements and striking bags than that shown such as a free standing support, without affecting the concept of the present invention.

Figure 2:
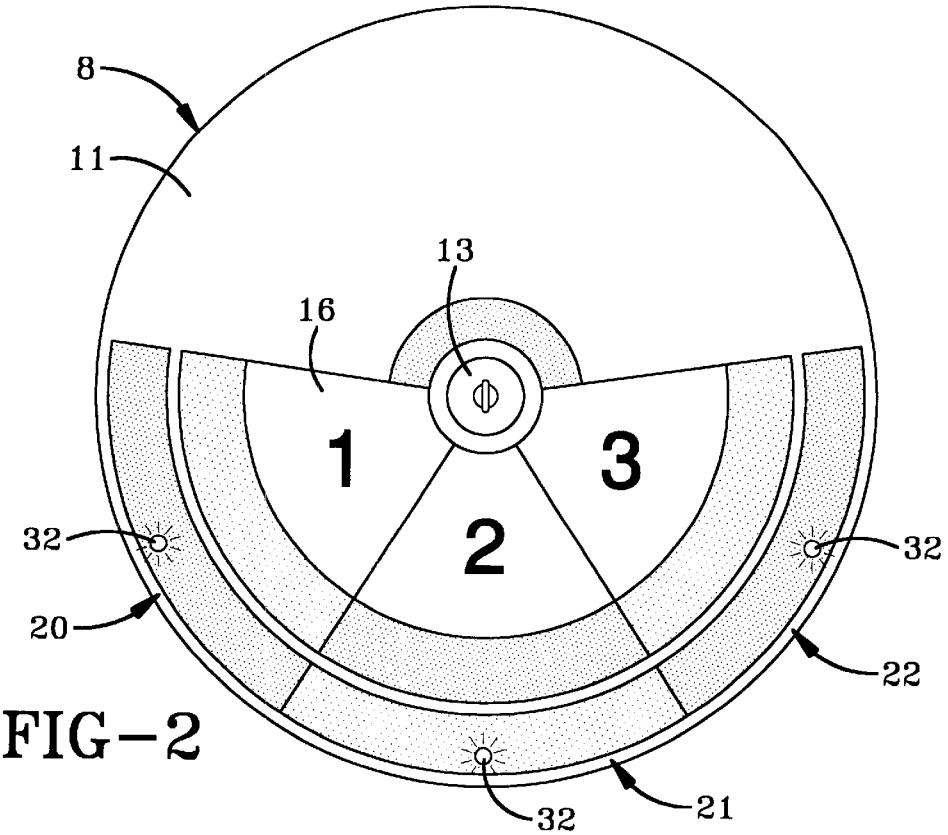
FIG. 2 is a plan view of the underside surface of the platform supporting the speed bag.
Figure 2A:
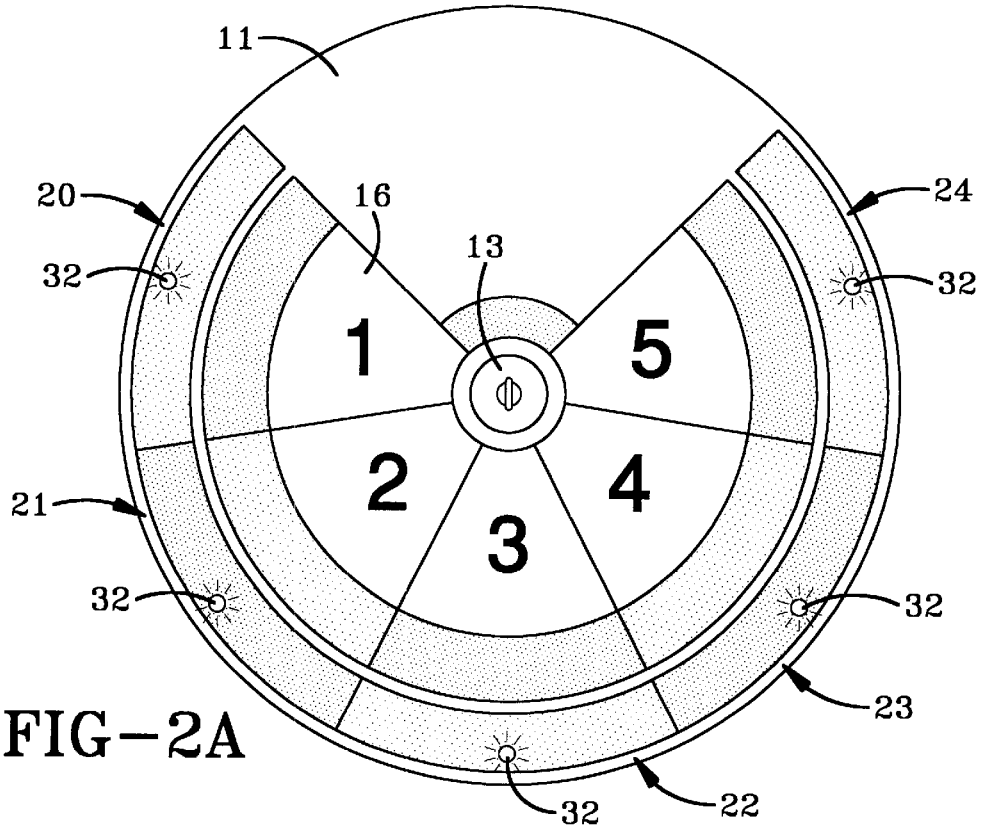
FIG. 2A is a view similar to FIG. 2 showing a modified arrangement of pressure responsive zones on the bag supporting platform.

In accordance with the invention a series of strike zones 20, 21 and 22 are printed on a fabric cover 16 or decal and secured to surface 11 of platform 8 by an adhesive or other type of fastening means as shown in FIG. 2. Three such strike zones are shown in FIG. 2 although this number could vary as shown in FIG. 2A in which two additional strike zones 23 and 24 are provided. Strike zones 20, 21 and 22 in the embodiment shown in FIG. 2, will have a generally pie-shaped configuration with an arcuate length of approximately 60° whereas the strike zones shown in FIG. 2A will also be pie-shaped, but will have an arcuate length of approximately 50°. Again, the number, position and size of the strike zones can vary without affecting the concept of the invention.

Figure 3:
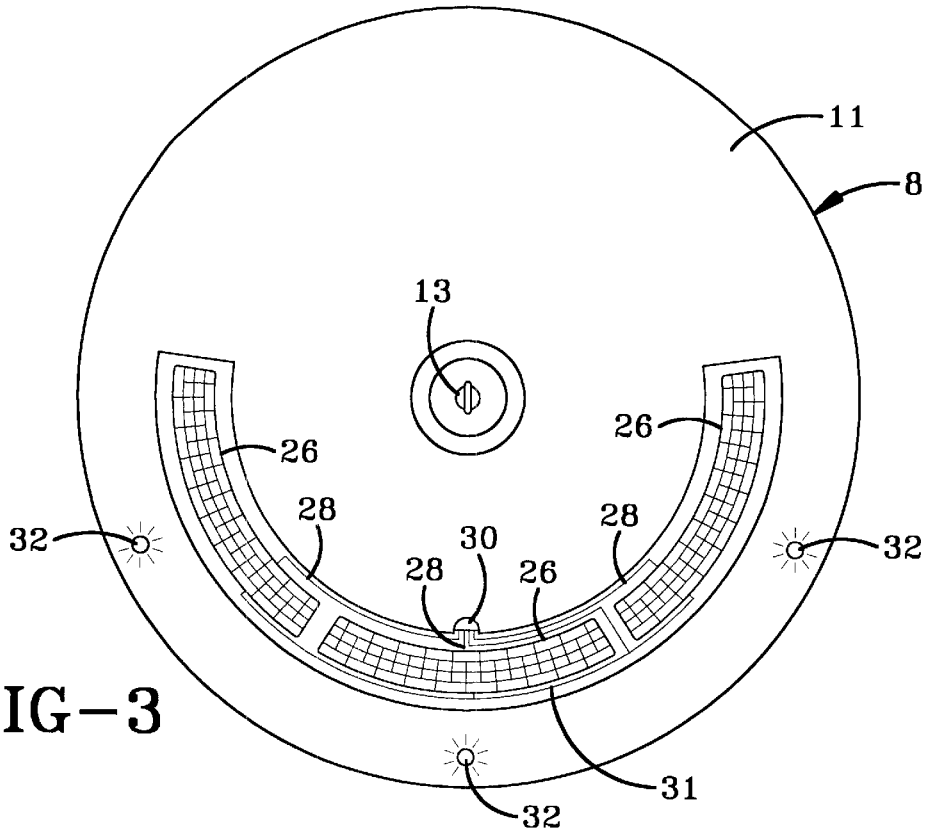
FIG. 3 is a view similar to FIG. 2 with the outer pressure zone indicating cover being removed therefrom showing the underlying pressure responsive strips.

Each of the strike zones has a pressure responsive strip 26 secured to underside surface 11 of platform 8 (FIG. 3). Each strip 26 includes a common wire 31 and a hot wire 28 all of which extend through a hole 30 formed in the platform and connect to a terminal 29 (FIG. 4) located on upper surface 10 of platform 8. Strip 26 is referred to in the electronic industry as a membrane key. However, other types of pressure responsive members can be used.

In further accordance with the invention, a light 32 or other type of signaling device such as audio, which in the preferred embodiment is an LED, is mounted on surface 11 of platform 8 adjacent each strike zone 20–22, but out of the path of bag 12 to prevent damage thereto. Each light 32 is connected to a pair of wires 33, one of which is connected to a terminal 34 located on upper surface 10 of platform 8, and the other directly to a circuit board 37. All of the wires (FIG. 4) extend to an electronic control unit indicated generally at 35, which includes the electronic control circuit or circuit board 37 and an indicating monitor 40. Control unit 35 will be connected to a source of power 38, such as 120 volts by a power cord 39 or a self contained battery pack. The particular construction of circuit board 37 and circuitry thereof can have various configuration and can be developed easily by one skilled in the art in order to achieve the various programs and results set forth below. Thus, no particular wiring arrangement or circuit board configuration is described in further detail.

Monitor 40 (FIG. 5) preferably has a number of viewing windows which provide various visual indications of the measurable feedback by the use of device 1 as described below. Window 41 provides time and windows 42 and 43 provide scores when the device is used by two players as a game as well as an exercise device.

Figure 5:
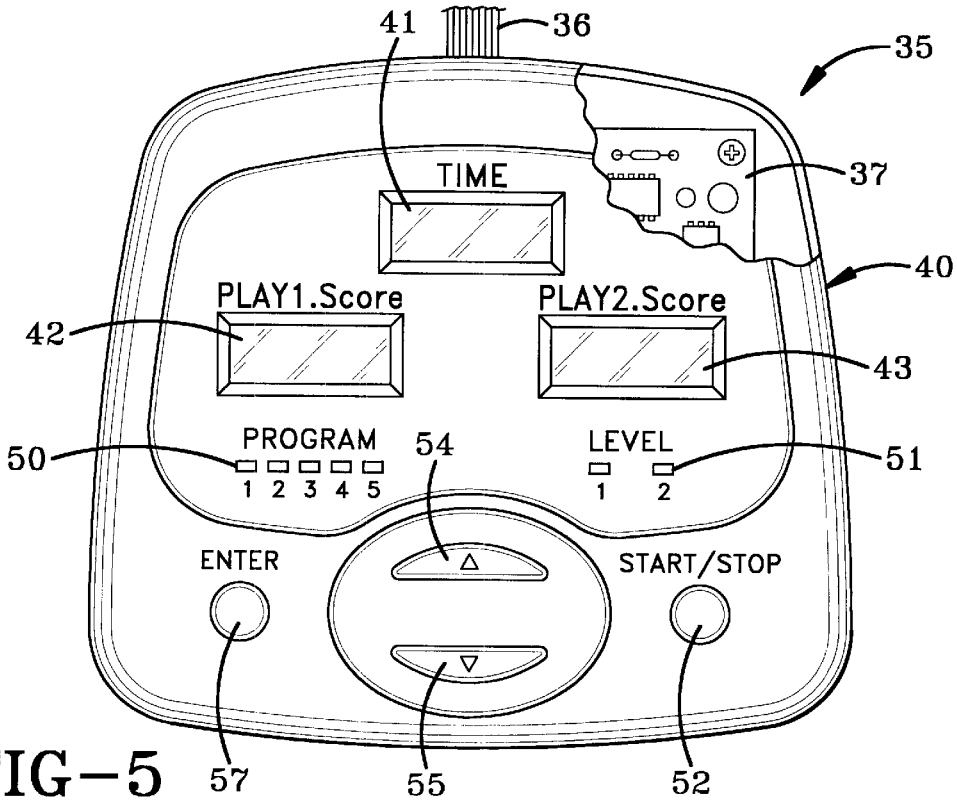
FIG. 5 is a plan view with portions broken away, of the monitor component of the electronic control circuitry.

A series of LEDs 50, five of which are shown in FIG. 5, indicate to the user what exercise program has been selected and is in operation. These LEDs are spaced below the designation PROGRAM. A pair of LEDs 51 are located beneath the designation LEVEL and identify which level or degree of difficulty was selected by the user. A START/STOP button 52 is used to start and stop the running of the selected program. The particular program is selected by using the scroll up or scroll down buttons 54 and 55 respectively. An ENTER button 57 is used to enter the selected program after use of buttons 54 and 55, which illuminates one of the program LEDs 50. Again, these visual indications and arrangements on monitor 40 can vary without effecting the concept of the invention.

A number of different workouts or programs are provided by exercise device 1. For example one program is referred to as a speed workout. In this workout, the circuitry is programmed so that a particular light 32 is illuminated for one of the contact zones requiring the user to position himself or herself to strike the bag with either the right or left hand so that the struck bag will contact the designated contact zone and pressure responsive strip 26 each time the bag is properly hit. Each time strip 26 is struck by bag 12, which number will correspond to each time the bag is struck by the user, a signal will be sent to the control circuitry which records the number of hits or strikes. Also an audio signal such as a beep preferably is provided each time the activated zone is struck by the bag. After a predetermined number of hits are recorded, for example 10 or 20 depending upon the selected level, the circuitry will automatically turn off the previously illuminated light 32 and illuminate another zone light 32 whereupon the boxer immediately shifts his or her body and uses either the same or the opposite hand for striking the bag so that the bag now strikes the newly illuminated zone. The user continues to strike the bag as fast as possible until the preset number of hits are recorded whereupon the circuitry automatically will turn out this illuminated light and actuate another of the zone lights 32, again requiring the boxer to immediately change position as well as the angle at which the bag is struck by either the same or opposite hand. The electronic circuitry will immediately inactivate the light and internal counting mechanism when the final number of strikes is received by the final contact zone. A visual indication is then provided in window 41 on monitor 40 as to the total time required to strike all three zones, each the required number of times. However, if the device is used by two players as a contest or game the individual times will appear in windows 42 and 43.

Another type of workout which can be performed with device 1 is a timed program wherein light 32 for each zone is lighted for a predetermined time and the number of hits that occurs in that zone while the zone is energized or lighted is counted and displayed in one of the viewing windows after the program sequences through all of the contact zones either in a particular or random sequence. Thus, the control circuitry automatically records the number of strikes in each of the zones which occurs during the preset time period and provides the total number of hits which occurs during the programed sequence in contrast to the speed workout where the total time is given to achieve a certain number of hits.

The control circuitry will automatically turn off one of the zone lights and turn on one of the other zone lights in a particular or random sequence requiring the boxer to immediately adjust his or her stance and bag striking hand depending upon which of the strike zones is illuminated. The number of required hits in the speed workout and the time period for each activated zone for the time workout can be adjusted by selecting the desired level as indicated by LEDs 51. Thus, the user of device 1 develops hand speed as well as hand eye coordination, in addition to improved footwork in order to shift his or her body to strike the bag correctly in order for the bag to strike the activated contact zone. All of these motions are performed as rapidly as possible since the time is recorded and visually indicated to the user, to evaluate speed and to provide an indication for improvement, as well as adding to the enjoyment of the exerciser and/or players of the game if used as an amusement device. It is readily understood that the quicker the bag is struck greater will be the aerobic effect achieved by the user.

The above described programs are examples of only several of the types of workouts which can be incorporated into control circuitry of circuit board 37. Numerous other sequences or programs can be provided by inserting various control chips into the circuit board. As can be seen in FIG. 1, the structure and manner of use of a usual speed bag is not changed thereby enabling the boxer and/or exerciser to strike the bag in a similar manner prior to incorporating the novel control circuitry therein.

Figure 7:
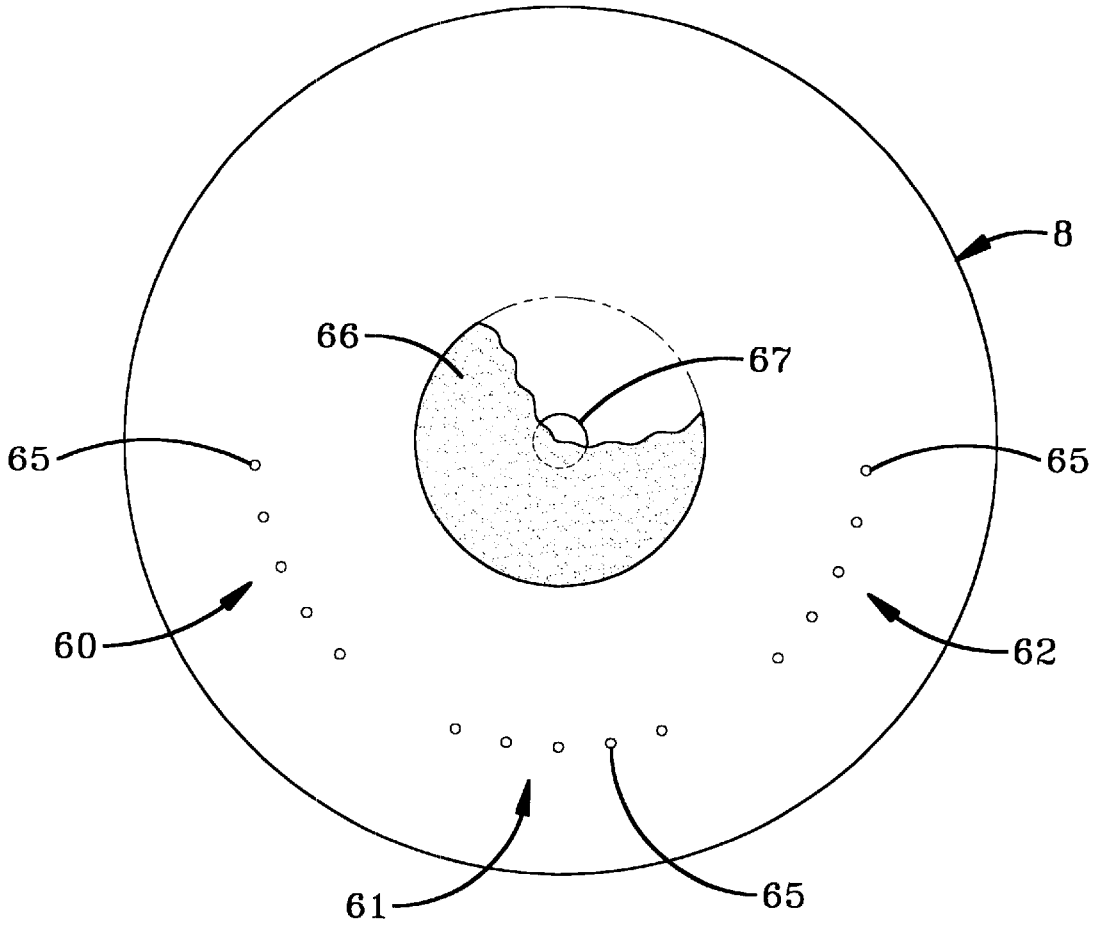
FIG. 7 is a plan view similar to FIG. 3 showing a modified embodiment of the present invention.

A further modification of the present invention is shown in FIG. 7 wherein the platform 8 is still provided with three contact zones 60, 61 and 62, each of which has a plurality of detection locations 65 such as lasers embedded or projecting through disc 8, which are operatively connected to control circuit 37. This system also provides an audio sound or beep each time the activated zone is struck by the bag and sensed by devices 65. Another type of striking device such as a foam cylinder 66, is supported on a flexible shaft 67 replacing the above described inflatable bag 12. Thus, the embodiment shown in FIG. 7 merely illustrates another manner in which the subject invention can be carried out in order to provide a measurable feedback to a user thereof who strikes a movable target such as bag 12, foam cylinder 66, or similar structure which in turn moves into a contact zone where its presence is measured, such as by the pressure sensitive strips 26, lasers 65 or other types of detection means, all of which provide a signal to the control circuitry.

Furthermore, it is readily seen that the subject invention can be provided as a kit and incorporated into an existing speed bag assembly by adding the detecting devices into the platform 8 with the appropriate wiring extending to control circuit 37 and monitor 40, which then is located adjacent the platform. Thus, the invention can be easily retrofitted with only minor modifications to an existing support platform in order to provide a measurable feedback to a user thereof without requiring major modifications to an existing speed bag and mounting platform.

Also, the embodiment shown in FIG. 7 need not require LEDs, but can be programmed so that an audio indication is given to the user such as a recording stating "zone 1" is activated, which after a predetermined time period or number of hits, will provide another audio indication, such as "zone 3" is activated, immediately telling the user to strike the foam cylinder and/or bag at a different angle for striking zone 3. Again, either lights or audio signals can be used to indicate to the user which zone is activated.

Accordingly, the improved exercise device apparatus is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the exercise device is constructed and used, the characteristics of the construction, and the advantageous new and useful results obtained; the new and useful structures, devices, elements, arrangements, parts, combinations and method steps are set forth in the appended claims.

What is claimed is:

1. An exercise device comprising:

a support;

a bag suspended from the support for striking by a user and for rebounding off of the support after being struck by a the user;

a series of spaced responsive contact zones on the support adapted to generate a signal when an activated one of said zones is struck by the bag;

an indicating device associated with each of the responsive contact zones to indicate which of the zones is activated; and an electronic control system operatively connected to the indicating devices and to the responsive contact zones for receiving the signals generated by the contact zones.

2. The device defined in claim 1 wherein the electronic control systems counts the number of times a particular one of said zones is struck by the bag.

3. The device defined in claim 1 wherein the indicating device is a light; and in which the electronic control system activates the light associated with the particular activated contact zone from which the strikes are being counted.

4. The device defined in claim 3 wherein the lights are LED's mounted on a surface of the support.

5. The device defined in claim 1 wherein the support includes a surface containing indicia defining the responsive contact zones.

6. The device defined in claim 5 wherein each of the responsive contact zones includes an arcuate strip of pressure sensitive material mounted on the surface of the support.

7. The device defined in claim 1 wherein the electronic control system includes a monitor which provides an objective measurement to the user of the number of times an activated contact zone is struck by the bag within a period of time.

8. The device defined in claim 1 wherein the bag is suspended form the support by a swivel.

9. The device defined in claim 1 wherein the electronic control system includes a monitor which provides an objective measurement to at least two different users of the speed at which each of the users struck the bag.

10. The device defined in claim 1 wherein there are at least three responsive contact zones, each of which extends throughout an arcuate area generally between 50° and 60°.

11. The device defined in claim 1 in which the indicating device is an audio transmission.

12. A method of exercising comprising the steps of:

providing a bag moveably suspended from a support for striking by a user and subsequently contacting a surface of the support;

providing a series of selectively activated responsive contact zones on the surface for generating a signal when the zone is contacted by the bag;

providing a series of indicating devices, each of which is associated with a respective one of the contact zones to provide an indicating signal to the user which of said contact zones is activated;

providing an electronic control system operatively connected to the contact zones for receiving the signals generated by the activated contact zones;

repeatedly striking the bag causing it to contact the activated contact zones and generating a signal in response to said contact;

counting the number of times the bag contacts the said activated zone within a period of time; and providing an objective measurement of the bag contacting the said activated zone.

13. The method defined in claim 12 including the step of activating one of the contact zones for a predetermined time period and counting the number of times the bag contacts said activated zone.

14. The method defined in claim 13 including the step of de-energizing the said activated zone and energizing another of said contact zones after a predetermined number of contacts of the said one activated contact zone by the bag.

15. The method defined in claim 13 including the step of de-energizing the said one activated contact zone and energizing another of said contact zones after a predetermined time period.

16. The method defined in claim 12 including the step of varying the time period each of said contact zones is activated.

17. The method defined in claim 12 including the step of providing at least three responsive contact zones.

18. The method defined in claim 12 including the step of providing an audio signal each time the said one contact zone is struck by the bag.

19. The method defined in claim 12 including the step of providing an audio signal as to which of the contact zones is activated.

20. A kit for retrofitting an existing exercise device having a striking bag movably suspended from a support wherein said bag is adapted to be repeatedly struck by a user, said kit comprising:

a plurality of responsive devices adapted to be mounted in a spaced array on the support to form a plurality of selectively activated contact zones and to provide a signal when the activated contact zone is struck by the bag;

an indicating system providing a visual or audio signal to the user which of the contact zones is activated; and an electronic control system for operatively connecting to the responsive device and indicating system for selectively activating one of the contact zones and for receiving the signals from the responsive devices and counting the number of times the activated contact zone is struck by the bag.

21. The kit defined in claim 20 wherein the indicating system includes a plurality of lights.

22. The kit defined in claim 20 wherein the responsive devices are pressure responsive strips.

23. The kit defined in claim 20 wherein the control system measures the number of times the activated contact zone is struck by the bag.

* * * * *